United States Patent [19]

Bugge et al.

[11] 4,112,982

[45] Sep. 12, 1978

[54] FORMING WIRE FOR USE IN PAPER-MAKING, CELLULOSE AND SIMILAR MACHINES

[75] Inventors: Hans Jörgen Bugge, Slattum; Ingvald Strandly, Oslo; Carl Olof Swanberg, Bekkestua, all of Norway

[73] Assignee: Nordiska Maskinfilt Aktiebolaget, Halmstad, Sweden

[21] Appl. No.: 769,779

[22] Filed: Feb. 17, 1977

[30] Foreign Application Priority Data

Feb. 24, 1976 [SE] Sweden ..... 7602211

[51] Int. Cl.[2] ..... D03D 15/02

[52] U.S. Cl. ..... 139/425 A; 162/348; 162/DIG. 1

[58] Field of Search ..... 162/348, DIG. 1; 139/425 A, 383 A; 245/8

[56] References Cited

U.S. PATENT DOCUMENTS 3,915,202 10/1975 Curtis et al. ..... 139/425 A

FOREIGN PATENT DOCUMENTS 366,353 4/1974 Sweden.

385,486 7/1976 Sweden.

*Primary Examiner*—S. Leon Bashore
*Assistant Examiner*—Peter Chin
*Attorney, Agent, or Firm*—Kane, Dalsimer, Kane, Sullivan and Kurucz

[57] ABSTRACT

A forming wire for use in paper-making, cellulose and similar machines, comprising a first layer of weft threads, which layer is intended in the position of use of the wire to face the material to be formed, a second layer of weft threads, which layer is intended in the position of use of the wire to face the machine drive rollers, and synthetic warp threads interweaving said two weft layers. Said first layer of weft threads crosses said warp threads on said outer face of the wire closest to the material to be formed, in at least 80% of all cross points, or according to the shaft (harness) number used in between 80% and 90% of all cross points, whereby the wefts on the wire face turned towards the material to be formed float over a large number of warps. The number of cross points on this wire face thus is reduced, eliminating the tendency of the wire to cause marking on sensitive paper qualities.

9 Claims, 24 Drawing Figures

Fig.5A
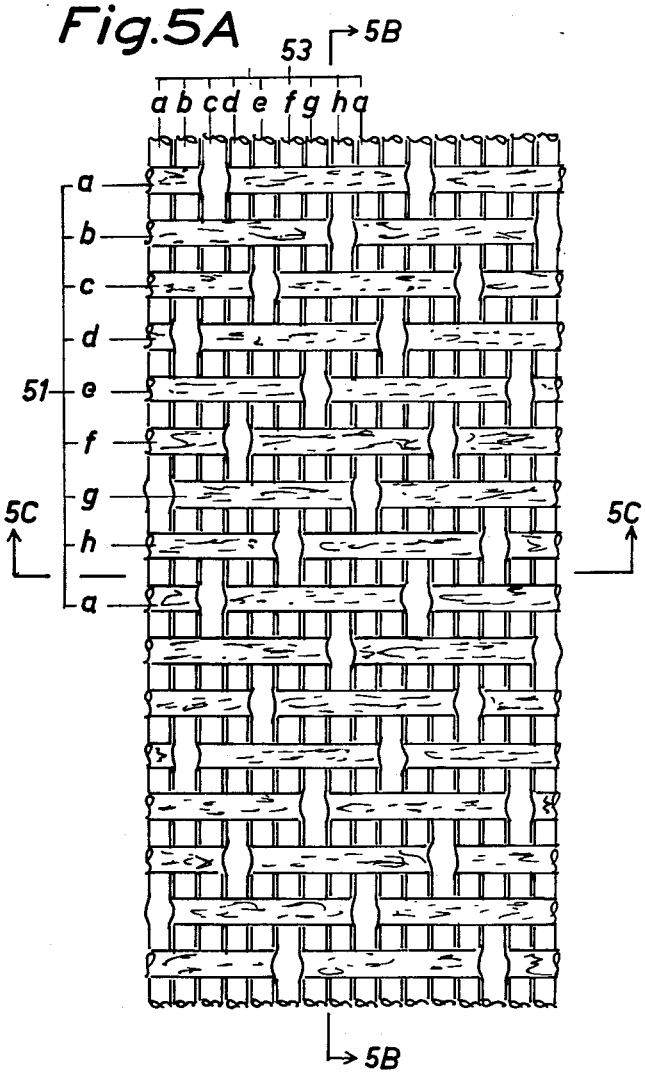
Fig.5B
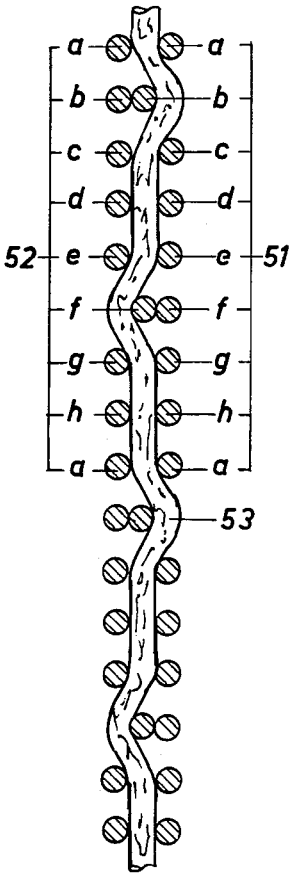
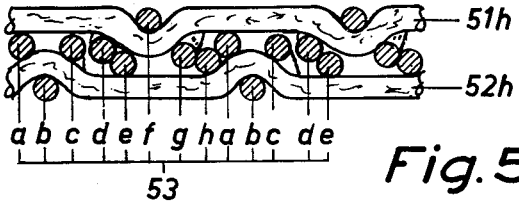
Fig.5C

Fig. 6A
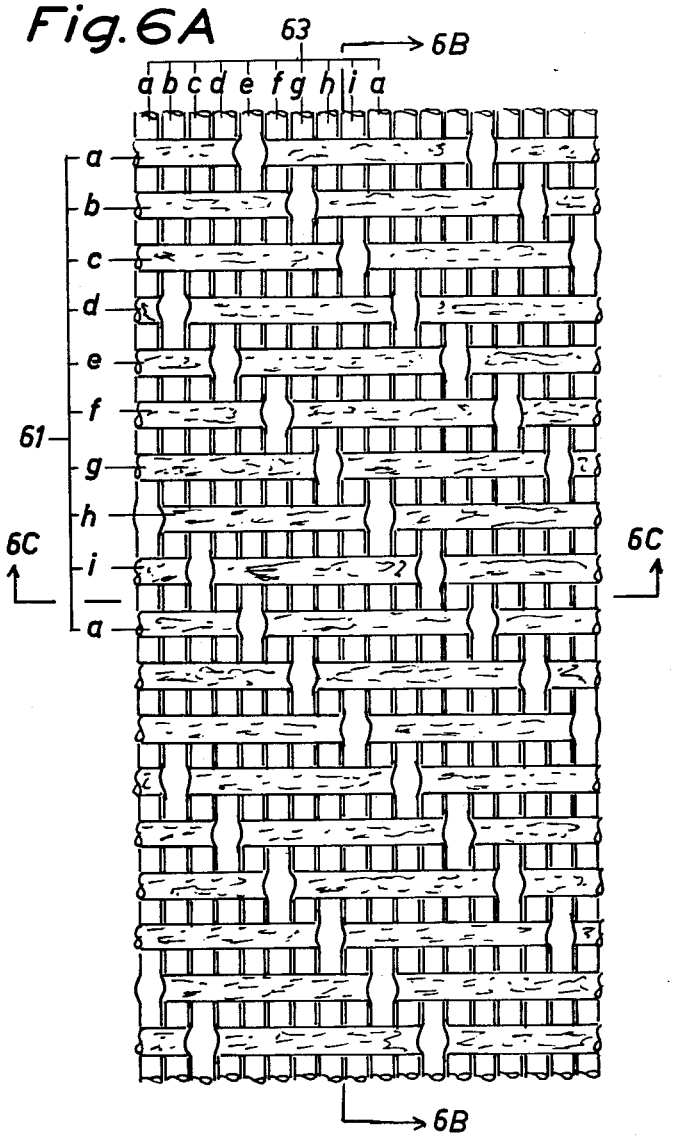
Fig. 6B
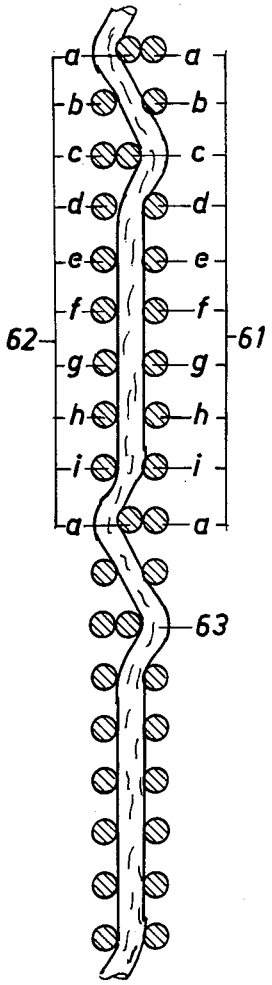
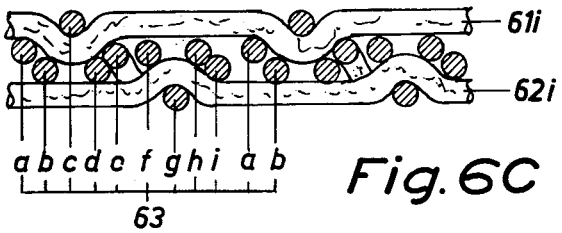
Fig. 6C

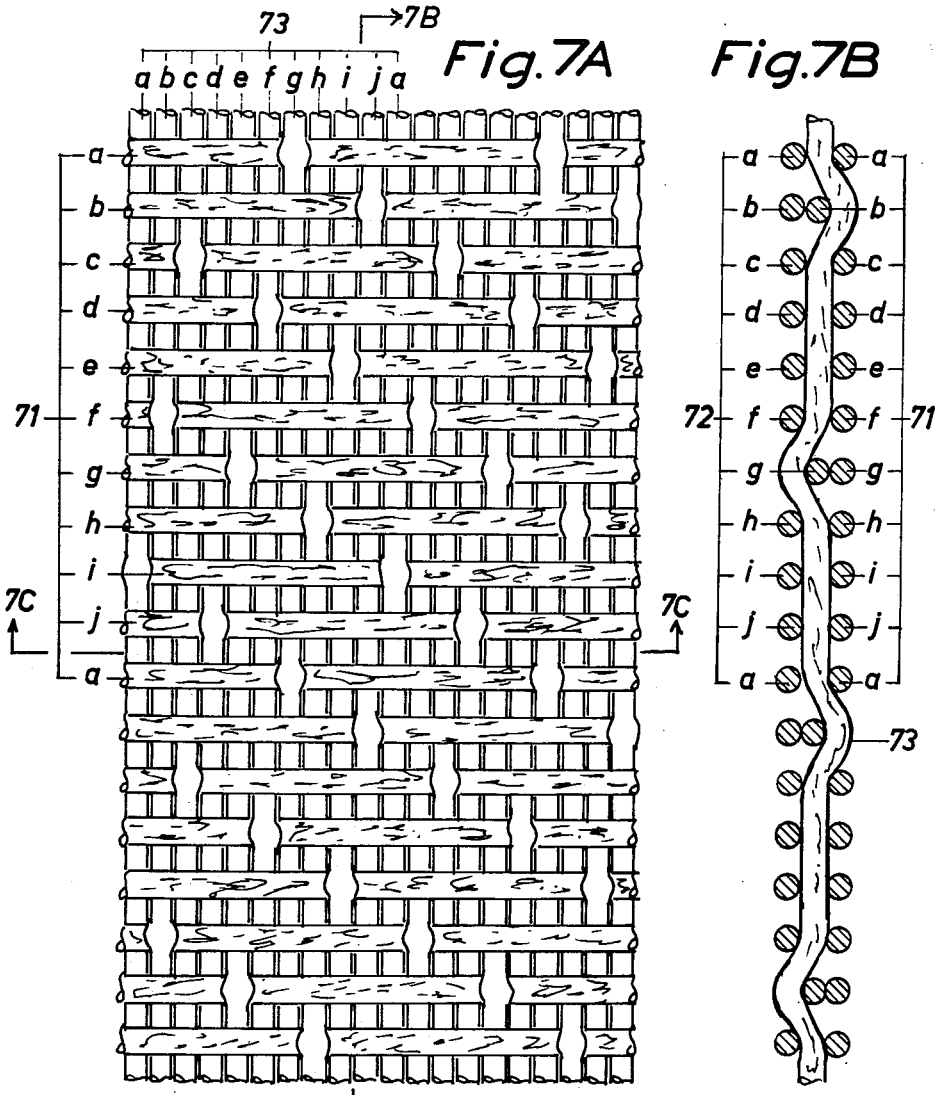
73
7B
a b c d e f g h i j a
Fig.7A
Fig.7B
a
b
c
d
e
71
f
g
h
i
j
a
7C
7C
72
f
71
73
7B
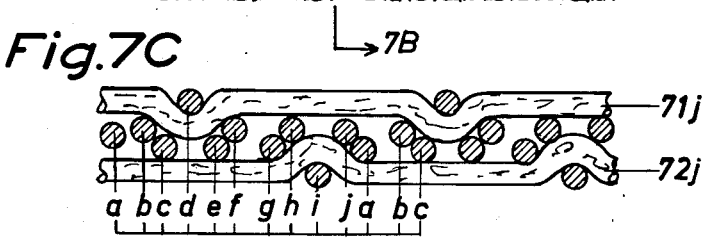
Fig.7C
71j
72j
a b c d e f g h i j a b c

FORMING WIRE FOR USE IN PAPER-MAKING, CELLULOSE AND SIMILAR MACHINES

BACKGROUND OF THE INVENTION

Forming wires for use in paper-making, cellulose and similar machines usually are in the form of a fine-mesh cloth which has been woven endless or otherwise joined into an endless web. As the very basis of good quality paper resides in the web formation itself, the structure of the forming wire is of vital and decisive importance. Until the middle of the fifties, all forming wires were manufactured from metal wires. These metal-wire cloths were useful in all kinds of paper-making machines and for all paper qualities. Around the date mentioned, metal-wire cloths, above all in cellulose machines, were replaced by single-layer cloths or wires of synthetic fibre threads, the so-called synthetic wires. The advantage of synthetic wires beyond metal-wire ones primarily resides in their improved wear resistance. Single-layer synthetic wires do, however, suffer from the disadvantage of having considerably higher elasticity and less stability than cloths made from metal wires of corresponding coarseness. On the large majority of up-to-date paper machines single-layer synthetic wires cannot be used at all, or only with difficulty, because of the large size and requirements on wire stability of such machines. Although considerable improvements have been made during recent years, only modest success has been achieved with single-layer synthetic wires on machines for e.g. wide and high-speed news-print paper, magazine paper and the so-called tissue paper machines. Also in the case of wide liner, kraft, and sack paper machines, several attempts have failed—despite the use of coarse and thus more stable single-layer synthetic wires.

The so-called double-layer synthetic wires consisting of two layers of one yarn system and a second yarn system interconnecting these layers have, as a result of their higher stability, considerably better chances of success on all types of paper-making machines, which several record runs also have evidenced.

A single-layer forming wire consists of two yarn systems only, the warp and the weft, whereas a double-layer wire must comprise at least three yarn systems. To interweave these yarn systems into a cloth possessing the same even surface structure as a single-layer cloth has hitherto caused the manufacturers large problems. The more complex binding structure of the double-layer wire involves marking problems, in that the structure of the yarns and/or the irregular mesh size leave traces in the paper sheet in the form of a so-called wire marking. The first double-layer synthetic wires had a geometrical structure that made it impossible in practice to bring to a common plane the two yarn systems closest to the material to be formed. The difference in levels between the knuckles of the warp and weft yarns caused such a pronounced marking that these wires were useful only in forming coarse paper qualities.

A considerable improvement is offered by the invention described in the Swedish Published Specification No. 366,353. The structure described therein makes it possible to locate the weft threads of the layer which in position of use of the wire faces the material to be formed, essentially tangentially to the wire plane facing said material. The invention provides a double-layer structure which is useful not only for coarse paper qualitites but also for the manufacture of e.g. newsprint paper.

In the manufacture of magazine and fine paper, the demands that the wire causes no marking are very high, among other reasons because the slightest tendency of the wire to cause marking, affects the printability of the paper. The wire structure described in the Swedish Published Specification No. 366,353 in several respects has proved suitable for use on many magazine paper machines, but its existing weak marking tendency, noticeable particularly diagonally with respect to the direction of travel of the wire and the paper, has limited its usefulness in these positions.

In the wire structure described in this Published Specification, each warp thread is made to bind or interweave separately with the layer of weft threads which in position of use of the wire faces the material to be formed. In this manner, the outer face of the wire will comprise a large number of short warp and weft float lengths.

A further development of the structure according to the Swedish Published Specification No. 366,353 is described in the Swedish Published Specification No. 385,486. The invention in accordance with this patent application likewise concerns a structure wherein the interconnecting synthetic warp threads also interweave separately with the weft threads of the layer of weft threads which in position of use faces the material to be formed. It is characteristic of the structure in accordance with the Swedish Published Specification No. 385,486 that the weft yarn on the opposite side of the wire which side in position of use thereof faces the dewatering members and thus is exposed to abrasion, is located tangentially to a plane positioned beyond the plane which is at a tangent to the warp threads interconnecting the layers. Owing to this structure, the wear resistance is increased in that a proportionally larger portion of the wear on the wire is transferred to the practically unloaded weft yarns.

SUMMARY OF THE INVENTION

The present invention relates to a forming wire for use in paper-making, cellulose, and similar machines, of the kind comprising a first layer of weft threads which in position of use of the wire faces the material to be formed, a second layer of weft threads, and synthetic warp threads interconnecting the weft layers. It is characteristic of the invention that the first layer of weft threads crosses said warp threads on the external side of the wire closest to the material to be formed, in 80% or more of all the cross points.

Through the subject invention, the warp knuckles on the outer face of the wire are limited to a minimum, and instead this wire face is formed to an essential degree by the weft or cross-direction yarn. This structure diminishes the demand that the two yarn systems are to be located tangentially to the outer plane of the wire, without causing a negative effect on the marking tendency. In addition, the number of binding points on the external face of the wire is considerably reduced, which also has proved to be clearly beneficial from a marking point of view.

BRIEF DESCRIPTION OF THE DRAWINGS

In the following the invention will be described in detail with reference to the accompanying drawings, wherein

FIGS. 2A–F illustrate in one plan view and five sectional views a wire structure in accordance with the invention, wherein FIGS. 2B and 2C are respectively a longitudinal sectional view along line 2B—2B and a cross-sectional view along line 2C—2C of FIG. 2A and wherein FIGS. 2D and 2E are respectively a similar longitudinal sectional view and a cross-sectional view but wherein the warp thread has a somewhat different extension (configuration), and wherein FIG. 2F is a further longitudinal sectional view.

FIGS. 3A–C, 4A–C, 5A–C, 6A–C, and 7A–C show further examples of five additional wire structures in accordance with the invention, wherein the figures designated A are plan views of the wire in question, the figures designated B are longitudinal sectional views along the lines designated B—B and the figures designated C are cross-sectional views along the lines designated C—C.

DETAILED DESCRIPTION OF PREFERRED EMBODIMENTS

Figure 1A:
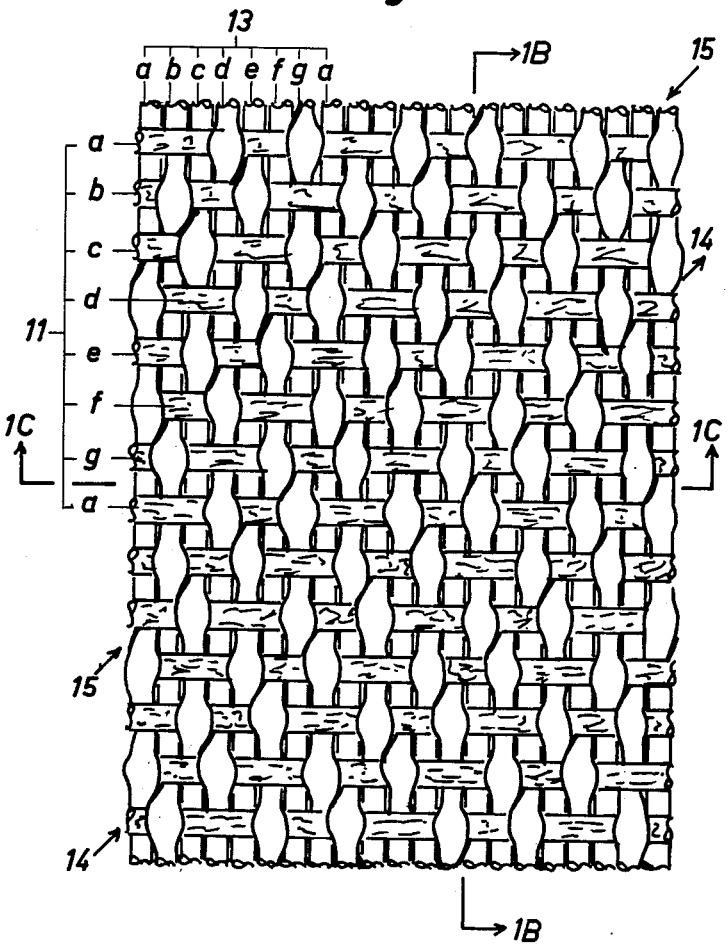
FIGS. 1A–C illustrate in one plan view and two sectional views the wire structure shown and illustrated in the Swedish Published Specification No. 366,353.
Figure 1B:
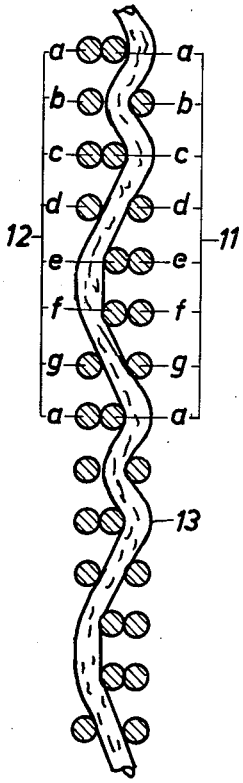
Figure 1C:
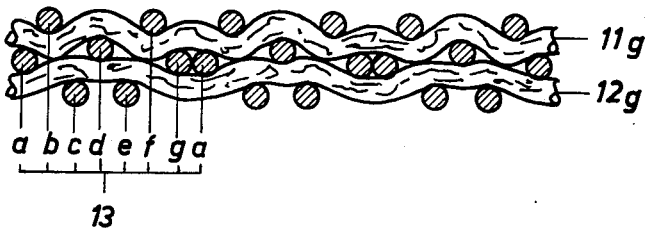

The wire in accordance with FIGS. 1A–C exemplify the already known and used wire structure consisting of two layers 11, 12 of synthetic weft threads and synthetic warp threads 13 interconnecting the two weft layers. The layer of weft threads which in position of use of the wire is to face the material to be formed and which makes up the outer face of the endlessly woven wire, is designated by reference number 11, whereas the inner face of the wire which is turned towards the drive rollers is designated by reference number 12. Each weft layer 11, 12 as well as the warp thread layer 13 interconnecting the weft layers consist of seven threads *a–g* each one of which has its specific weaving pattern. Within the textile technique, a weave of this structure is known as a seven-shaft (harness) weave. It is characteristic of this structure that the outer layer 11 of weft threads and the warp threads 13 interconnecting the two weft layers are located essentially tangentially to the outer plane of the wire. This condition is achieved in that each warp thread 13, in addition to interweaving the two weft layers, also is made to bind separately with the outer layer 11 of weft threads. Owing to this separate binding, the wire face turned towards the material to be formed, will consist of a large number of short warp and weft float lengths. By a "float length" is to be understood in this connection, the length of thread over which the yarn extends freely without being interwoven with another yarn. With reference to FIG. 1C, the float lengths of yarn 11*g* thus are formed as well above warp yarns 13*c*, 13*d*, and 13*e* as above warp yarns 13*g* and 13*a*. The wefts thus float over two and three warp threads, respectively. In a double-layer product, normally having a warp density that is twice that of a single-layer one, it has been found that the large number of binding or cross points that is a consequence of the many and short float lengths, tend to form diagonal patterns in the wire, which in turn cause marking of the paper web. In the structure illustrated in FIGS. 1A–C, such diagonal patterns can easily be traced, e.g. along lines 14—14 and 15—15.

In order to avoid these diagonal patterns the present invention provides a wire wherein the face of the wire intended to be turned towards the material to be formed, consists of long weft float lengths and the shortest possible warp float lengths. In this manner the binding or cross points have been reduced to a minimum, resulting in improved marking qualities, primarily when used with extremely sensitive paper qualities.

Figure 2A:
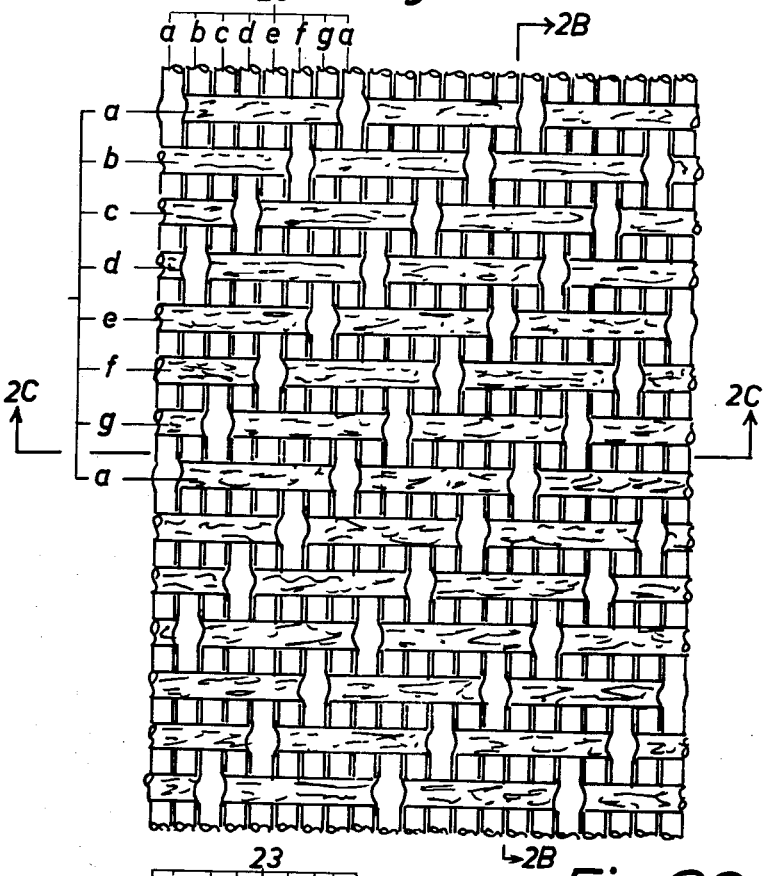
Figure 2C:
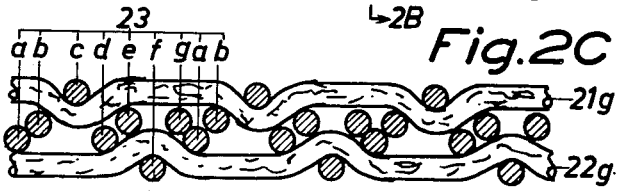
Figure 2E:
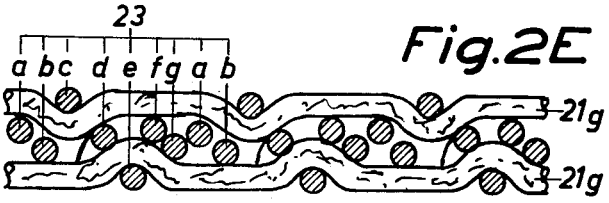
Figure 2B:
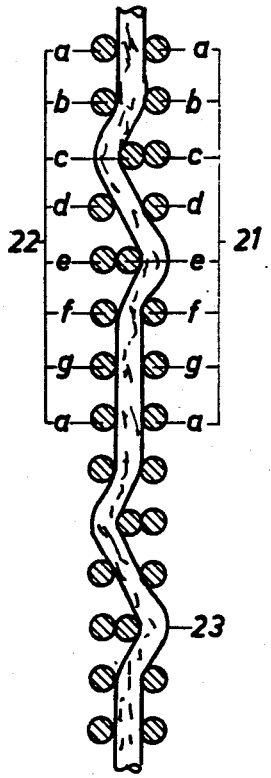
Figure 2D:
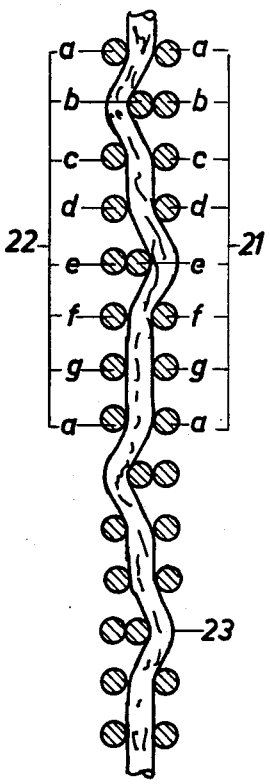
Figure 2F:
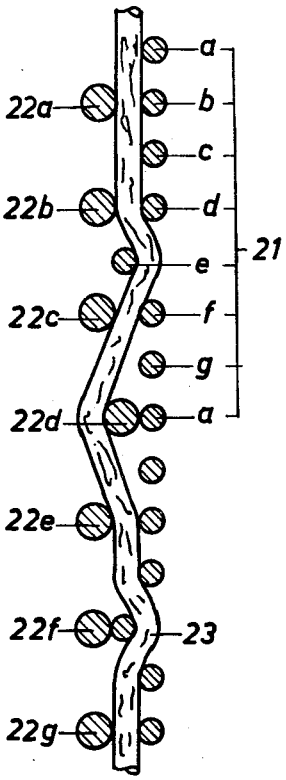
Figure 3A:
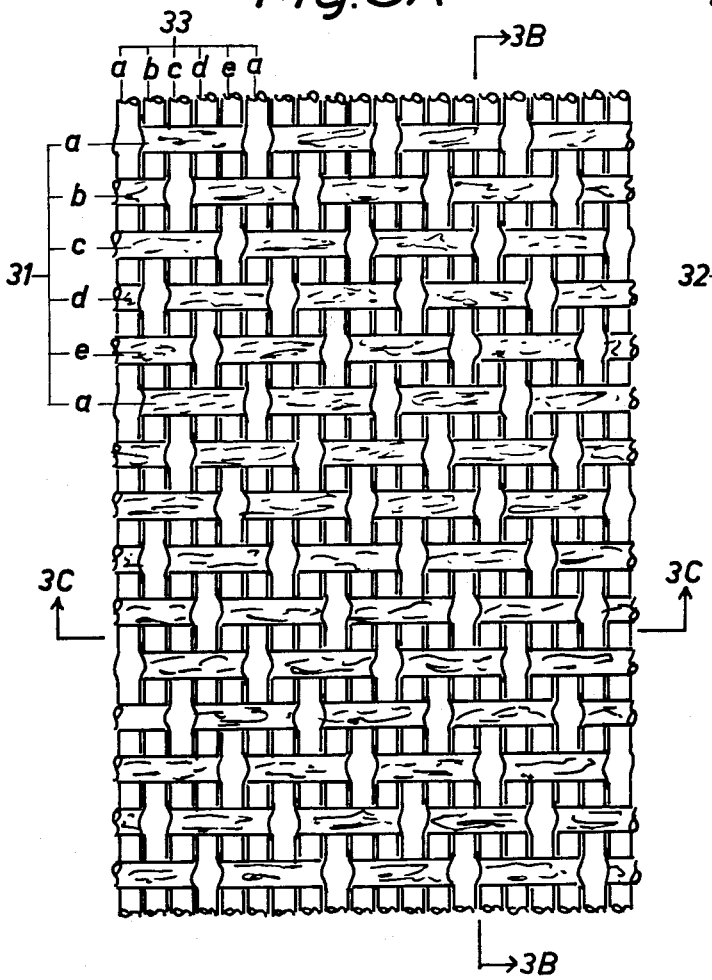
Figure 3B:
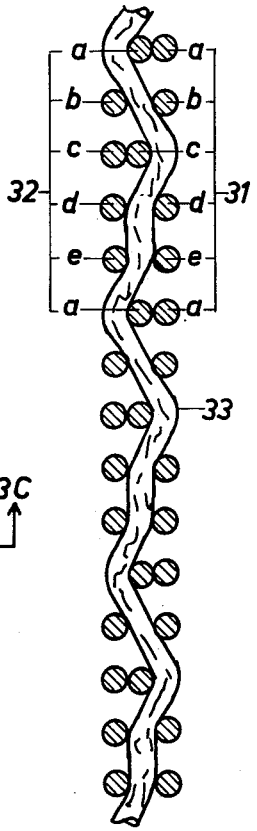
Figure 3C:
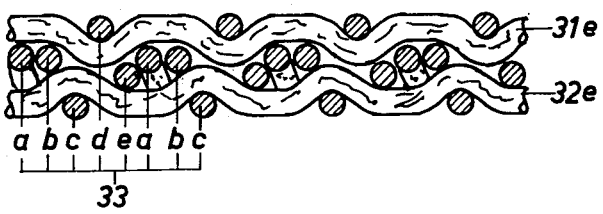

FIGS. 2A–E show a first embodiment of a wire in accordance with the teachings of the present invention. Like the prior-art wire, the novel wire comprises two layers 21, 22 of synthetic weft threads as well as synthetic warp threads 23 interweaving the two weft layers. Preferably all threads are monofilament threads, but also multifilament threads are useable. The layer of weft threads which in position of use of the wire is to face the material to be formed and which consists of the outer face of the endless wire, is designated 21, whereas the inner face of the wire which is turned towards the drive rollers, is designated 22. In accordance with the embodiment illustrated in FIG. 2F, the latter wire face is made up by half the number of weft threads compared with the number of the outer face of the wire. On the other hand, these weft threads may be coarser. Like in FIGS. 1A–C each one of weft layers 21, 22 as well as the interweaving warp threads 23 comprise seven threads *a–g* weaving in a different pattern, i.e. the weave is a so-called seven-shaft weave. The wire face turned towards the material to be formed, consists of long weft float lengths. In FIGS. 2C and 2D, the weft yarn 11 forms continuous float lengths above warp yarns 23*d*, 23*e*, 23*f*, 23*g*, 23*a*, and 23*b* whereas the weft yarn 11*g* only binds with one single one, 23*c*, of the seven warp yarns. The weft layer which in position of use faces the material to be formed, thus crosses the warp threads on the external face of the wire six times out of seven, i.e. in nearly 86% of all cross points.

FIGS. 3A–C–7A–C inclusive show examples of five other embodiments of wire structures. The wire illustrated in FIGS. 3A–C consists of one outer weft layer 31 and one inner weft layer 32 as well as layers of warp threads 33, each warp layer comprising five threads *a–e* weaving in different ways, i.e. a five-shaft weave. Each weft thread on the outer face of the endless wire floats over four warp threads (for example weft thread 31*c* above warp threads 33*e*, 33*a*, 33*b*, and 33*c*) and is interwoven with the fifth warp thread 33*d*. The threads of the outer weft layer thus crosses the warp threads on the outer face of the wire in four cross points out of five, or in 80% of the cross points.

Figure 4A:
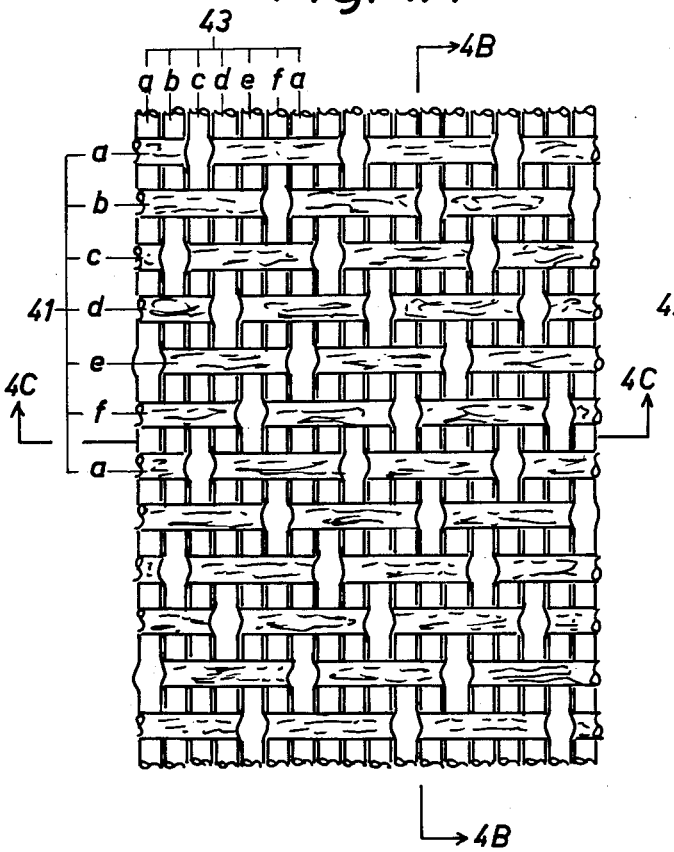
Figure 4B:
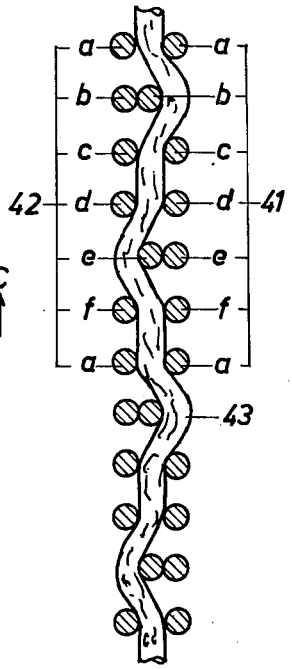
Figure 4C:
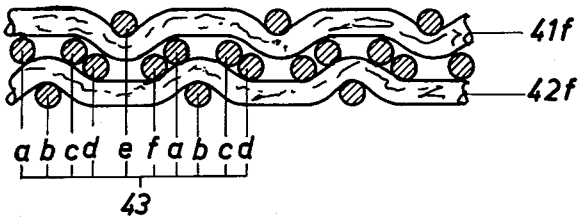

The wire structure illustrated in FIGS. 4A–C comprises one outer weft layer 41 and one inner weft layer 42 as well as layers of warp threads 43, interwoven in a six-shaft binding. Each layer consists of threads *a–f* each one weaving in a different way. Each weft thread on the outer face of the endless wire floats over five warp threads (e.g. weft thread 41*f* over warp threads 43*f*, 43*a*, 43*b*, 43*c*, and 43*d*) and is interwoven with the sixth warp thread 43*e*. The threads of the outer weft layer thus cross the warp threads on the outer face of the wire in five cross points out of six or in somewhat more than 83% of the cross points.

The structure illustrated in FIGS. 5A–C consists of one outer weft layer 51 and one inner weft layer 52 as well as warp thread layers 53 woven together into a eight-shaft binding. Each layer consists of threads *a–h*, each one weaving in its specific manner. Each weft thread on the outer face of the endless wire has float lengths extending over seven warp threads (e.g. weft thread 51*h* above warp threads 53*g*, 53*h*, 53*a*, 53*b*, 53*c*, 53*d*, and 53*e*) and is interwoven with the eighth warp thread 53*f*. The threads of the outer weft layer 51 thus cross the warp threads on the outer face of the wire in seven cross points out of eight, or in 87.5% of all cross points.

The structure illustrated in FIGS. 6A–C comprises one outer weft layer 61 and one inner weft layer 62 as well as layers of warp threads 63 interconnected into a nine-shaft binding. Each layer comprises threads *a–i*, each one weaving in its particular weaving pattern. Each weft thread on the outer face of the endless wire has float lengths extending over eight warp threads (e.g. weft thread 61 over warp threads 63*d*, 63*e*, 63*f*, 63*g*, 63*h*, 63*i*, 63*a*, and 63*b*) and is interwoven with the ninth warp thread 63*c*. The threads of the outer weft layer thus cross the warp threads on the outer face of the wire in eight cross points out of nine, or in almost 89% of the cross points.

The structure illustrated in FIGS. 7A–C consists of one outer weft layer 71 and one inner weft layer 72 as well as layers of warp threads 73 interconnected into a 10-shaft binding. Each layer consists of threads *a–j*, each one weaving in a different manner. Each weft thread on the outer face of the endless wire has float lengths extending above nine warp threads (e.g. weft thread 71*j* above warp threads 73*e*, 73*f*, 73*g*, 73*h*, 73*i*, 73*j*, 73*a*, 73*b*, and 73*c*) and is interwoven with the tenth warp thread 73*d*. The threads of the outer weft layers thus cross the warp threads on the outer face of the wire in nine cross points out of ten, or in 90% of the cross points.

The modifications of the structure described above in accordance with the invention are to be regarded as examples only, and may be multiplied within the scope of the appended claims. For instance, shaft numbers higher than 10-shaft are possible. The interweaving of the inner weft layer of the wire which in position of use is to be turned towards the drive rollers of the machine, with its warp layer need not either be identical with that of the outer weft layer thereof, as illustrated in the drawings, but may be effected in a different way. Nor need the number of weft threads, thread dimensions, or the material of the two weft layers be identical. Also within the same weft layer and/or warp layer, thread dimensions and materials may vary.

What we claim is:

1. An improved forming wire for use in paper-making, cellulose and similar machines, comprising a first layer of weft threads facing the material formed on the wire, a second layer of weft threads facing the machine drive rollers, and synthetic warp threads interweaving said two layers of weft threads, the improvement comprising said first layer of weft threads crossing said warp threads on the outer face of said wire closest to the material to be formed, in at least 80% of all cross points.

2. An improved forming wire as claimed in claim 1, wherein on said outer face of said wire, turned towards the material formed, each thread of said first layer of weft threads crosses six out of seven successive said warp threads.

3. An improved forming wire as claimed in claim 1, wherein on said outer face of said wire, turned towards the material formed, each thread of said first layer of weft threads crosses four out of five successive said warp threads.

4. An improved forming wire as claimed in claim 1, wherein on said outer face of said wire, turned towards the material formed, each thread of said first layer of weft threads crosses five out of six successive said warp threads.

5. An improved forming wire as claimed in claim 1, wherein on said outer face of said wire, turned towards the material formed, each thread of said first layer of weft threads crosses seven out of eight successive said warp threads.

6. An improved forming wire as claimed in claim 1, wherein on said outer face of said wire, turned towards the material formed, each thread of said first layer of weft threads crosses eight out of nine successive said warp threads.

7. An improved forming wire as claimed in claim 1, wherein on said outer face of said wire, turned towards the material formed, each thread of said first layer of weft threads crosses nine out of ten successive said warp threads.

8. An improved forming wire as claimed in claim 1, wherein said threads of said two layers of weft threads as well as the warp threads interweaving said weft layers, are synthetic monofilament threads.

9. An improved forming wire as claimed in claim 1, comprising said wire constructed with a weave pattern incorporating shaft numbers ranging from 5 to 24.

* * * * *